US008534504B2

(12) United States Patent
Archer

(10) Patent No.: US 8,534,504 B2
(45) Date of Patent: Sep. 17, 2013

(54) WALL-MOUNTED AND COUNTERTOP-MOUNTED DISPENSER

(75) Inventor: Matthew J. Archer, Aurora, OH (US)

(73) Assignee: GOJO Industries, Inc., Akron, OH (US)

( * ) Notice: Subject to any disclaimer, the term of this patent is extended or adjusted under 35 U.S.C. 154(b) by 160 days.

(21) Appl. No.: 13/051,385

(22) Filed: Mar. 18, 2011

(65) Prior Publication Data

US 2012/0234874 A1 Sep. 20, 2012

(51) Int. Cl.
*B67D 7/84* (2010.01)
*B67D 7/06* (2010.01)

(52) U.S. Cl.
USPC ..... 222/173; 222/181.3

(58) Field of Classification Search
USPC ..... 222/173, 181.2, 181.3, 207, 214, 222/526, 533
See application file for complete search history.

(56) References Cited

U.S. PATENT DOCUMENTS

| | | | | | |
|---|---|---|---|---|---|
| 2,727,658 | A | * | 12/1955 | Mart | 222/536 |
| 3,066,832 | A | * | 12/1962 | Rossetti | 222/207 |
| 3,938,769 | A | * | 2/1976 | Wetherbee | 248/312 |
| 4,261,356 | A | * | 4/1981 | Turner et al. | 604/246 |
| 4,456,007 | A | * | 6/1984 | Nakao et al. | 128/200.21 |
| 5,611,465 | A | * | 3/1997 | Lee et al. | 222/214 |
| 5,897,031 | A | * | 4/1999 | Wirt et al. | 222/179 |
| 5,975,372 | A | * | 11/1999 | Heyn | 222/181.3 |
| 2008/0251153 | A1 | * | 10/2008 | Bell et al. | 141/198 |

* cited by examiner

*Primary Examiner* — Paul R Durand
*Assistant Examiner* — Vishal Pancholi
(74) *Attorney, Agent, or Firm* — Renner Kenner Greive Bobak Taylor & Weber

(57) ABSTRACT

A dispenser that may be mounted on a wall or a countertop includes a housing having a fin shape. The housing includes a front cover and a back cover. The front cover and back cover define a leading surface and a trailing surface of a fin shape. The dispenser includes a nozzle assembly and the shape of the dispenser creates a dispensing area near the nozzle assembly and the trailing surface of the fin shape.

17 Claims, 7 Drawing Sheets

WALL-MOUNTED AND COUNTERTOP-MOUNTED DISPENSER

TECHNICAL FIELD

The present invention relates to dispensers that may be mounted in more than one orientation. In particular embodiments, the dispensers are selectively mounted in counter-mounted orientations or wall-mounted orientations and, in either orientation, dispense product downwardly in the generally accepted and practiced direction.

BACKGROUND

Various dispensers are known and used to dispense fluids such as lotions, soaps and sanitizers, whether as liquid or foam. Wall-mounted dispensers are a common form of dispenser. These dispensers generally include a dispenser housing that is adapted to receive refill units that carry the product that is to be dispensed. The refill units typically include a container, such as a bag or bottle, containing the product, and a pump is associated with the container such that, upon actuation, product is advanced from the container to an outlet of the dispenser.

Countertop-mounted dispensers are also a common form of dispenser, but are structurally distinct from the wall-mounted dispensers. These dispensers generally include an outlet of the dispenser positioned above a countertop, the outlet being associated with a container (containing a product that is to be dispensed) positioned below the countertop. A pump is associated with both the above-countertop outlet and the below-countertop container, and upon actuation, product is advanced from the container to the outlet.

Wall-mounted dispensers typically include all of the components necessary for the operation of the dispenser (including the pump, the product, and the outlet) within the dispenser housing. The components in countertop-mounted dispensers, on the other hand, are physically separated by the countertop, with some of the components being above the countertop and some components being below the countertop. Another difference between wall-mounted dispensers and countertop-mounted dispensers is that the containers for wall-mounted dispensers generally do not resemble the containers that are part of the refill units used with countertop-mounted dispensers. In particular, wall-mounted dispensers often use disposable, pliable containers that conform to the volume defined inside the housing, whereas countertop-mounted dispensers typically have refillable, hard plastic containers. Additionally, the containers in the wall-mounted dispensers are typically of smaller volume than those of the countertop-mounted dispensers. Thus, the refill units are distinct for each type of dispenser, and purchasers who opt to use both wall-mounted and countertop-mounted dispensers must purchase separate and distinct refill units for each type of dispenser.

Although mention has been made of dispensers that receive refill units that provide the container of product to be dispensed and the pump for dispensing the product, it will be appreciated that the prior art also includes bulk-fill dispensers wherein the container and pump mechanisms are retained as part of the dispenser, with the container being refilled with a bulk supply with product when empty. Regardless of whether wall-mounted dispensers or counter-mounted dispensers are formed to be bulk-fill type dispensers or of a type that would receive a refill unit, it will be appreciated that these two types of dispensers are provided by very distinct structures in the prior art. That is, the inventors herein are not aware of any particular dispenser that is suitable for selectively mounting in either a counter-mounted orientation or a wall-mounted orientation as desired by the entity installing the dispenser.

Thus, a need exists in the dispenser arts for dispensers that are more versatile, being capable of use either as a wall-mounted dispenser or a countertop-mounted dispenser in accordance with the desire of the entity offering the dispenser for use. This need exists for both bulk-fill dispensers and dispensers designed to receive refill units. In dispensers employing refill units, a need also exists for dispensers that accept the same size and type of refill unit despite whether being used as a wall-mounted dispenser or counter-mounted dispenser.

SUMMARY OF THE INVENTION

In one embodiment, this invention provides a dispenser including a housing and a rotatable dispensing nozzle assembly. The housing includes a base that is selectively mounted to a generally vertical surface, in a vertical mounting orientation, and selectively mounted to a generally horizontal surface, in a horizontal mounting orientation. The housing is shaped to define an undercut. The rotatable dispensing nozzle assembly is secured to the housing at the undercut and is selectively rotated between a first position associated with the horizontal mounting orientation, and a second position associated with the vertical mounting orientation. In the first position, the dispensing nozzle is directed to dispense product toward the generally horizontal surface and the undercut provides a finger receipt area sufficient for at least the receipt of fingers between the dispensing nozzle and the generally horizontal surface. In other embodiments, when the base is mounted in the vertical mounting orientation and the rotatable dispensing nozzle assembly is rotated to the second position, the dispensing nozzle is positioned to dispense product below the housing.

In accordance with other embodiments of this invention, the housing includes a front cover and a back cover. The front cover includes a front surface and a bottom surface and the back cover includes a top surface and a bottom surface. The front cover and the back cover form a leading surface and a trailing surface, the trailing surface providing the undercut. The nozzle assembly is positioned near the intersection of the leading surface and the trailing surface.

In one or more embodiments, the housing comprises a leading surface and a trailing surface that together form a fin shape.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
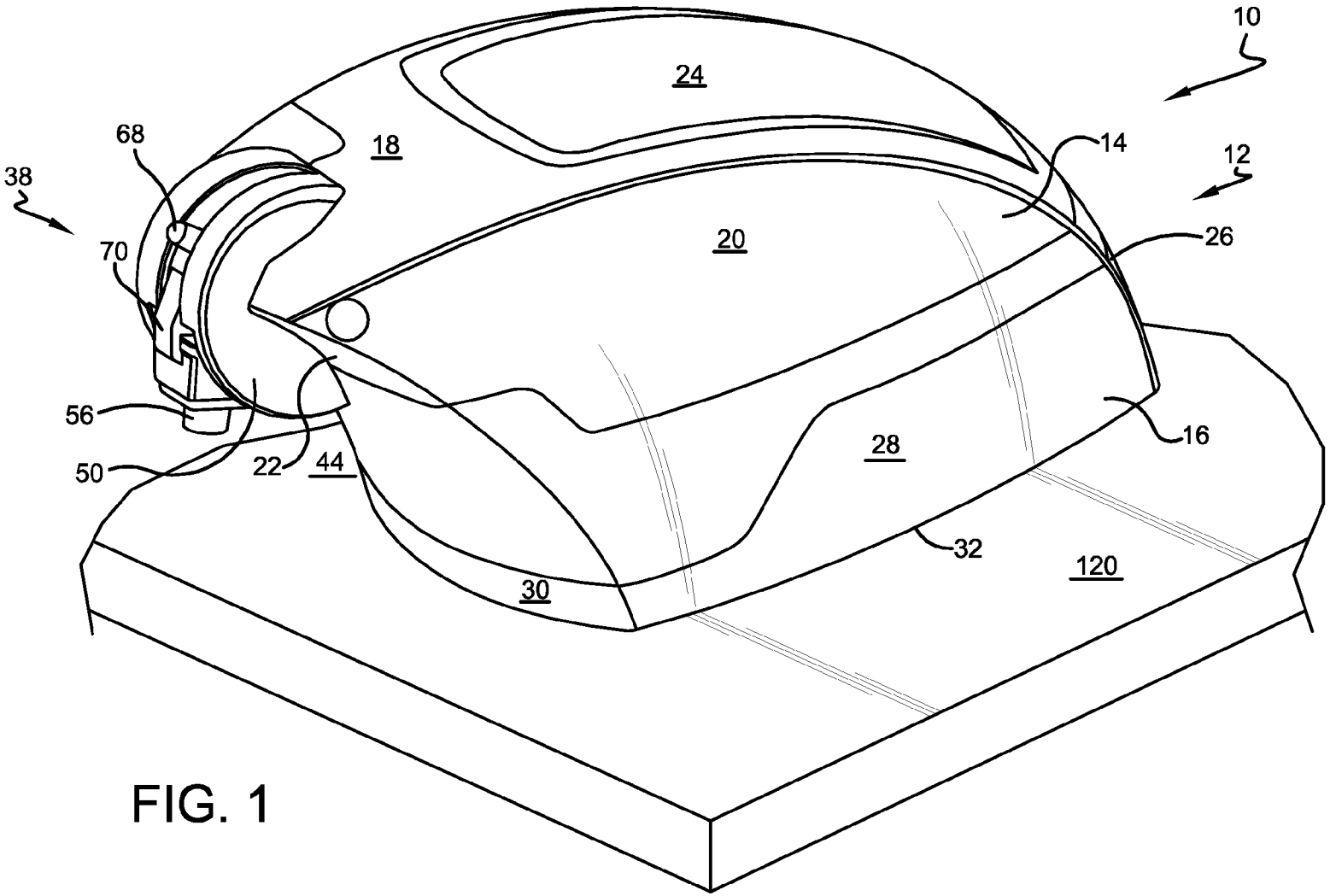
FIG. 1 is a perspective view showing a dispenser constructed according to the concepts of the present invention mounted on a countertop.
Figure 2:
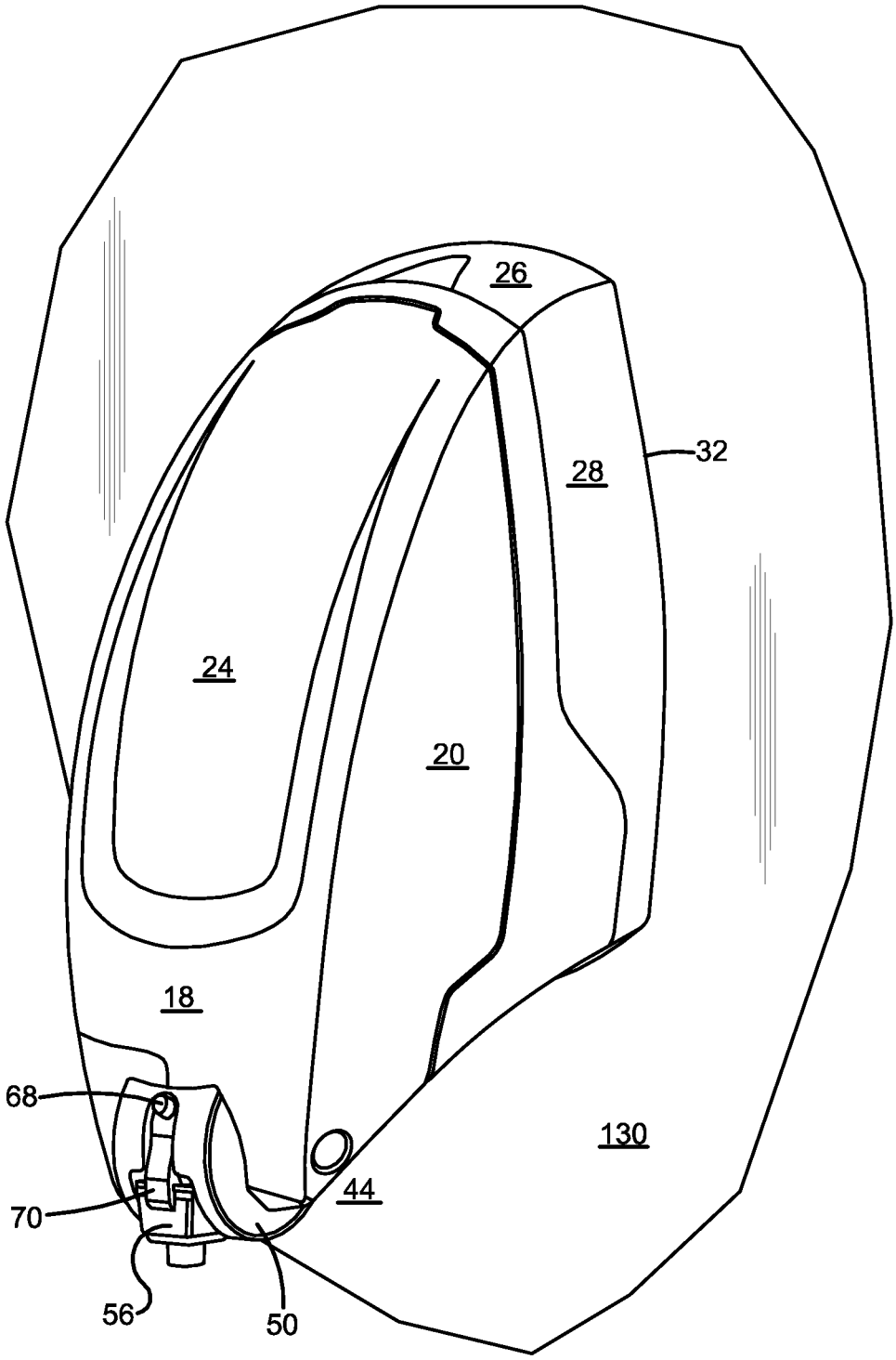
FIG. 2 is a perspective view showing the dispenser of FIG. 1 mounted on a wall.

Referring to the figures, a dispenser constructed according to the concepts of the present invention is generally indicated by the numeral 10. As shown in FIG. 1, dispenser 10 can be mounted on a countertop (or any other flat, generally horizontal surface), or, as shown in FIG. 2, dispenser 10 can be mounted on a wall (or any other flat, generally vertical surface).

Dispenser 10 includes a housing 12 comprised of a front cover 14 and a back cover 16. A volume is defined within the housing 12, and that volume may be accessed according to methods known in the art, including those discussed below. The front cover 14 includes a front surface 18, side surfaces 20, and a bottom surface 22. Front cover 14 may optionally include a transparent window 24 to enable a user to see within the volume defined within housing 12.

Back cover 16 includes a top surface 26, side surfaces 28, and a bottom surface 30. As seen in the figures, the front surface 18 of the front cover 14 is generally curved such that it transitions to abut the top surface 26 of back cover 16 and form a generally smooth continuous outer surface. Similarly, side surfaces 20 of front cover 14 abut side surfaces 28 of back cover 16, and bottom surface 22 of front cover 14 abuts bottom surface 30 of back cover 16. The abutment of the various surfaces of front cover 14 and back cover 16 results in housing 12 having generally continuous surfaces in the areas near the abutments. Back cover 16 may include a backplate (not shown) having structure for mounting the dispenser 10 onto a surface. Back cover 16 includes a peripheral edge 32 defined by surfaces 26, 28, 30 that is generally flat and planar so that dispenser 10 will rest flat against a flat surface. Dispensers, including dispenser 10, can be mounted to a surface using structure and methods well known in the art.

Front cover 14 and back cover 16 may be detachably connected to each other using any known method or structure in the dispenser arts. A clamshell arrangement is well known in the dispenser arts, and is suited for use with dispenser 10. In such a clamshell arrangement, front cover 14 is pivotally connected to back cover 16, and to access the volume defined within housing 12, a user simply pivots the front cover 14 out of contact with back cover 16. Of course, other arrangements for connecting front cover 14 and back cover 16 may also be used.

Figure 3:
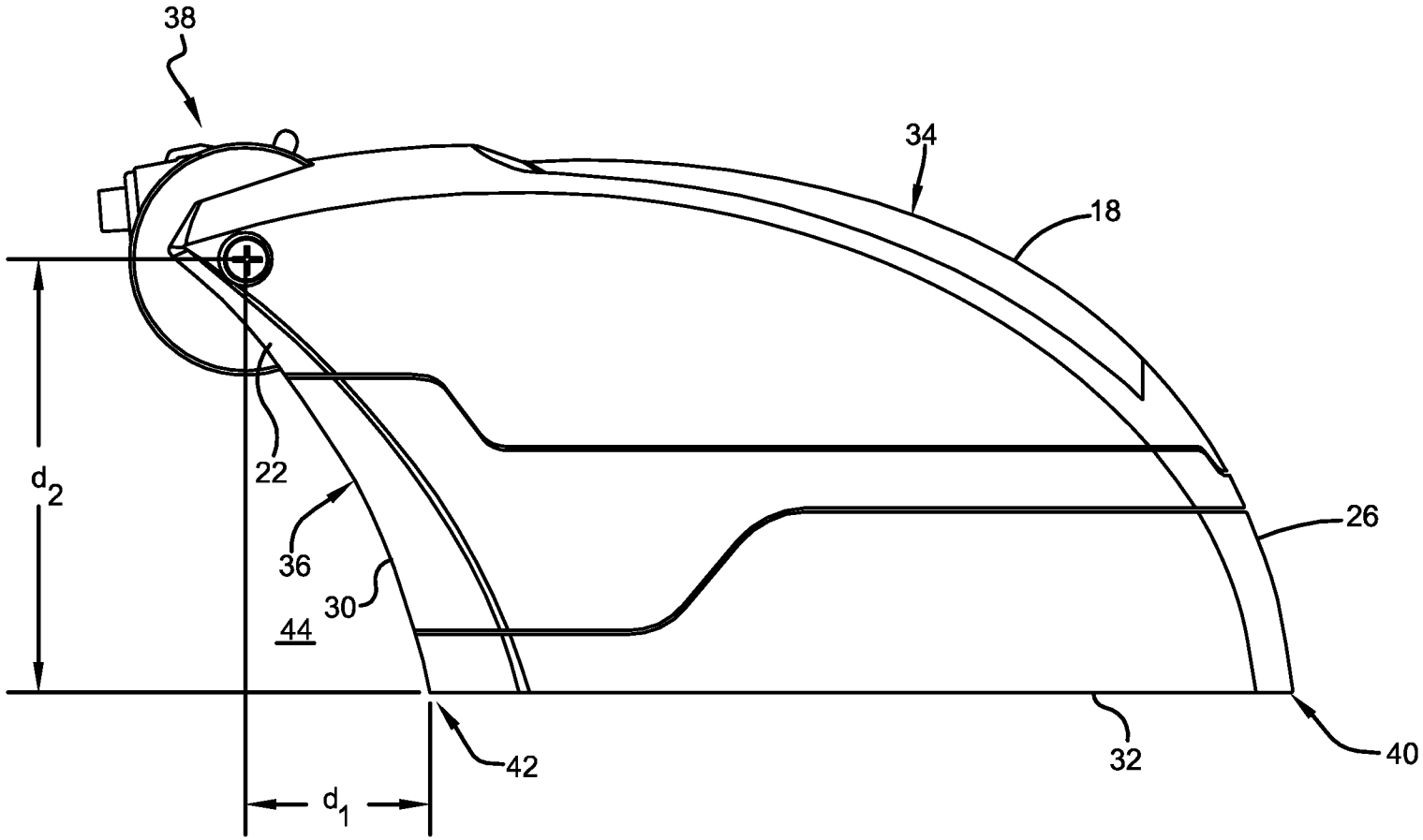
FIG. 3 is a side plan view of the dispenser and shows that the housing is generally shaped like a fin.

Referring to FIG. 3, it can be seen that the particular shape of housing 12 dispenser 10 is generally fin-shaped when viewed from the side. The shape will be recognized as being similar to a curved dorsal fin (as on a fish). In such a fin shape, front surface 18 of front cover 14 and top surface 26 of back cover 16 define a curved leading surface 34 of the fin shape. Bottom surface 22 of front cover 14 and bottom surface 30 of back cover 16 define a curved trailing surface 36 of the fin shape. Of course, although leading surface 34 and trailing surface 36 are generally smooth, continuous, and curved, other arrangements could be conceived that still define a leading surface and trailing surface, giving the dispenser a shape that is generally fin-shaped. For example, the fin shape could be defined by more than one generally planar portion.

Although a fin shaped has been disclosed for housing 12, it should be appreciated that this is merely an aesthetically pleasing acceptable embodiment, and other shapes could be practiced. As will become more apparent herein, the importance of the fin shape relates to its provision of an undercut 44. Thus, in accordance with this invention and the concepts taught herein, other housing shapes could be employed provided they define the desired undercut 44 as described herein. For example, as seen FIG. 6, angular structures define a blocky housing 12' defining an undercut 44 at a ledge 37 that carries a rotatable dispensing nozzle 38. It should also be appreciated that the curved trailing surface 36 could be formed as a general planar surface, creating a undercut under that surface by extending it from the base at an obtuse angle.

A rotatable dispensing nozzle assembly 38 is secured to the housing at the undercut. In this embodiment of FIGS. 1-5, it is positioned approximately at the apex of the fin shape, which is roughly where leading surface 34 meets trailing surface 36. As viewed from the side, back cover 16 extends along peripheral edge 32 in the longitudinal direction between a first end 40 and a second end 42. First end 40 lies on peripheral edge 32 near its intersection with top surface 26, and second end 42 lies on peripheral edge 32 near its intersection with bottom surface 30. In the embodiment of FIG. 6, it can be seen that the rotatable dispensing nozzle assembly 38 is secured to the housing at the undercut 44 by being positioned within the ledge 37, particularly at the distal end thereof.

Trailing surface 36 arcs away from second end 42 in both the longitudinal direction and a direction that is orthogonal to the longitudinal direction of dispenser 10 shown in FIG. 3 (hereafter orthogonal direction, which is generally at a right angle to the longitudinal direction in the arrangement shown in FIG. 3). Thus, nozzle assembly 38 is positioned longitudinally beyond, and spaced from in the orthogonal direction, second end 42. Particularly, the center of nozzle assembly 38 is positioned a distance d1 in the longitudinal direction, and a distance d2 in the orthogonal direction, from second end 42. Nozzle assembly 38 is thus positioned longitudinally beyond most other parts of dispenser 10, and particularly outside of the footprint defined by the peripheral edge 32. A generally concave undercut 44 is thereby defined by the position of nozzle assembly 38 and the arc of the trailing surface 36. The undercut 44 provides a finger receipt area that is sufficient for at least the receipt of fingers between the dispensing nozzle 56 and the counter top 120, when the dispenser 10 is mounted in a generally horizontal orientation as in FIG. 1. By placing the fingers or hand between the dispensing nozzle 56 and the counter, a user can receive a dosage of product dispensed from dispenser 10. In a preferred embodiment, distance d1 is approximately 1.25 inches and distance d2 is approximately 3.5 inches. Of course, the size of distance d1 and distance d2 may be modified based on the requirements of a particular application, so long as the distances are chosen to be practical for the receipt of at least a portion of a user's fingers and/or hand in the defined dispensing area between the dispensing nozzle 56.

Figure 4:
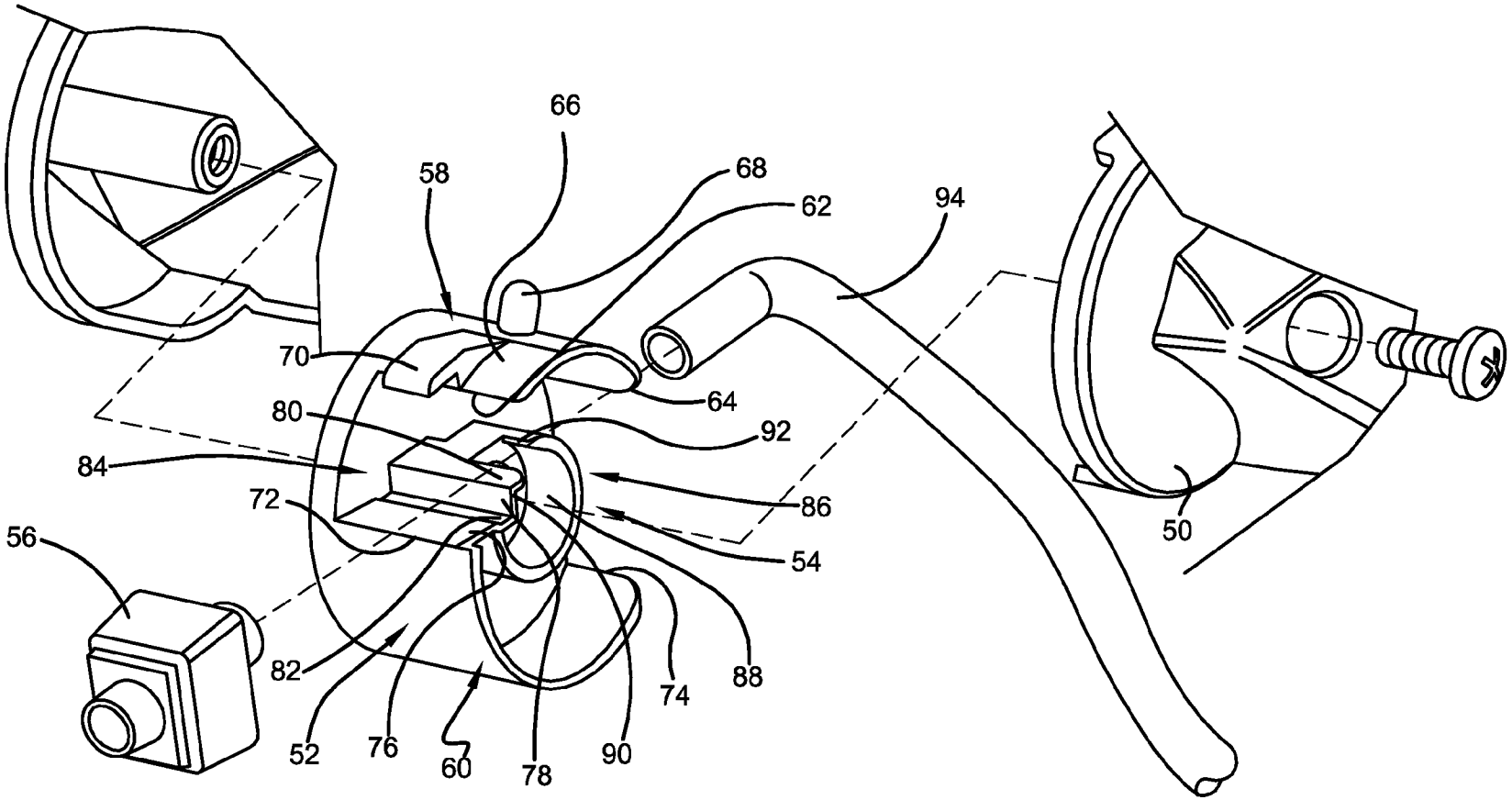
FIG. 4 is an exploded view of a portion of the dispenser showing some of the components positioned within the housing, including the rotatable dispensing nozzle assembly.

As best seen in FIGS. 1-3, rotatable dispensing nozzle assembly 38 includes a generally cylindrical shaped stationary housing 50, within which many of the other components of assembly 38 rotate. Referring also to FIG. 4, assembly 38 includes a pivot 52, a pivot stop 54, and a dispensing nozzle 56.

Figure 5A:
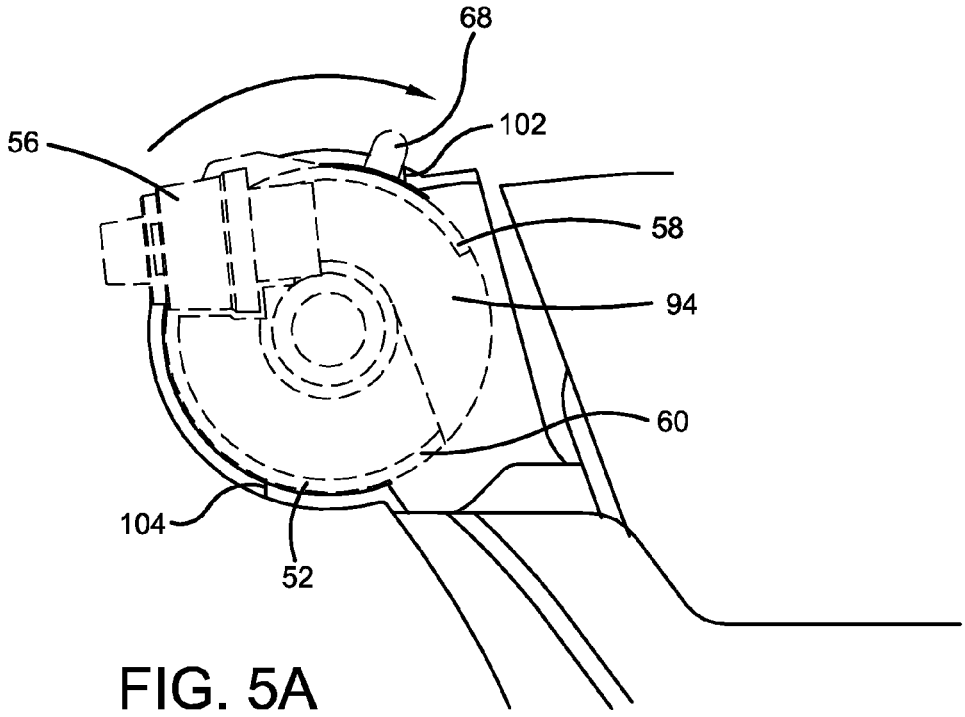
FIGS. 5A and 5B are side views of the rotatable dispensing nozzle assembly, showing the dispensing nozzle in two possible positions.
Figure 5B:
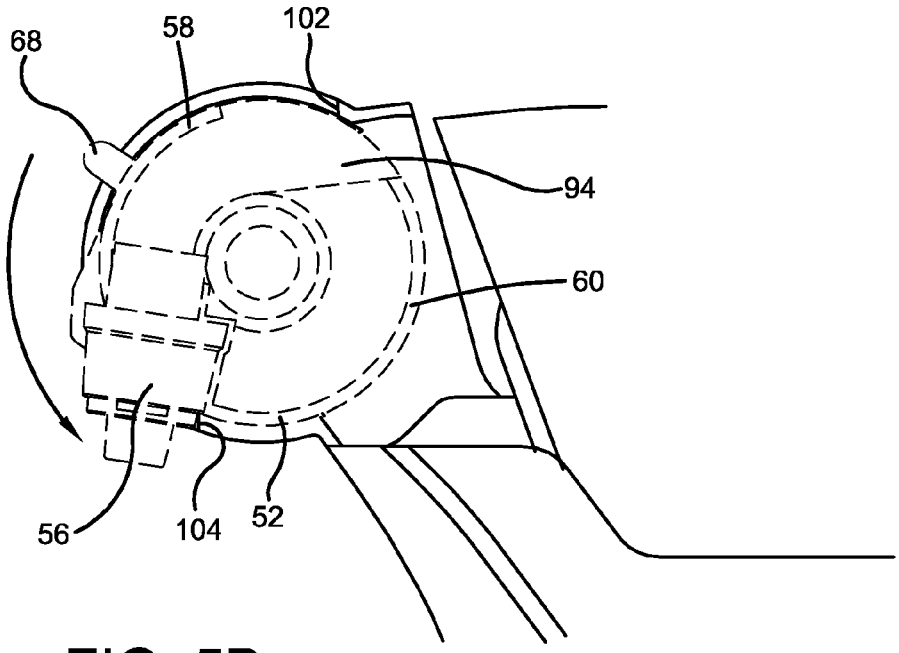
Figure 6:
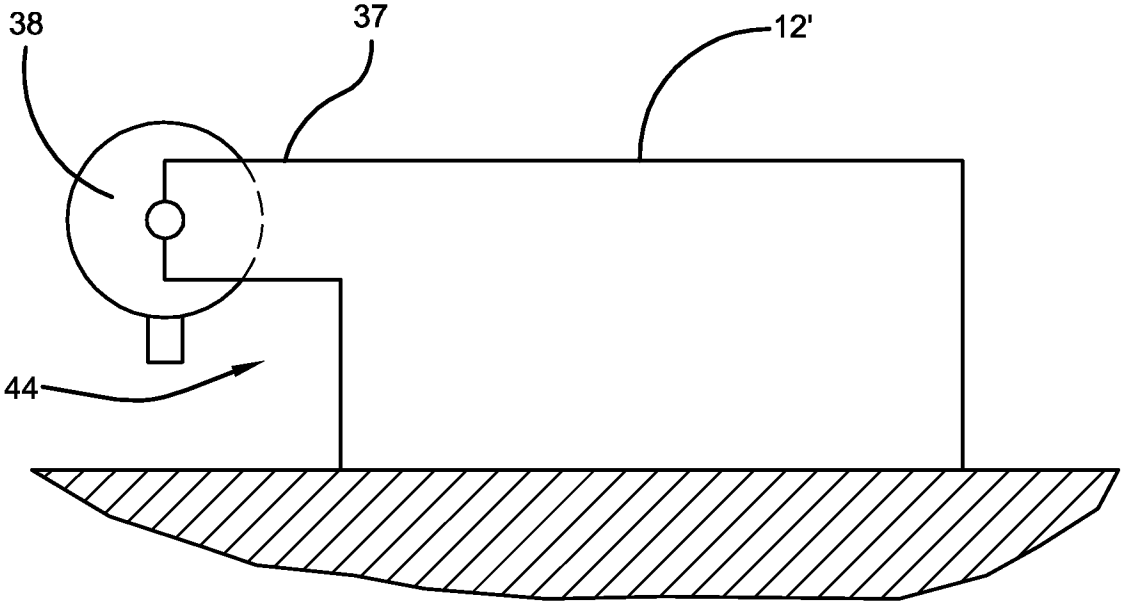
FIG. 6 is a side plan schematic view of an alternative shape for the dispenser housing.

Referring now to FIGS. 4, 5A and 5B, pivot 52 is generally tube-shaped and includes two circumferential wall portions, first wall portion 58 and second wall portion 60. First wall portion 58 extends from a first end 62 to a second end 64, and includes a radial outer surface 66. A nub 68 extends from radial outer surface 66 between first end 62 and second end 64, and a clip 70 positioned near first end 62 extends from outer surface 66 to a distal end extending circumferentially beyond the first end 62. Second wall portion 60 extends from a first end 72 to a second end 74. A nozzle carrying platform 76 extends radially inward from second wall portion 60 near first end 72. A back wall 78 extends roughly perpendicular from platform 76 near the end of platform 76 opposite first end 72, and a ledge 80 extends roughly perpendicular from an end of back wall 78 opposite platform 76. Nozzle carrying platform 76 may include a recessed axial channel 82 proximate back wall 78 to accommodate a complementary shaped rim on the nozzle 56. A first open space 84 is defined in the circumference of pivot 52 between the first ends 62, 72 of wall portions 58, 60. A second open space 86 is defined between the second ends 64, 74 of wall portions 58, 60. Pivot 52 rotates about an axis, which, in the embodiment shown, is centrally located.

Pivot stop 54 is also generally tube-shaped and includes a wall portion 88 that extends a portion of the circumference of stop 54 from a first end 90 to a second end 92. Pivot stop 54 does not rotate.

Dispensing nozzle 56 can be any suitable nozzle known or developed in the dispensing arts, and is positioned in the first open space 84 between first ends 62, 72 of wall portions 58, 60. Particularly, nozzle 56 is positioned on nozzle carrying platform 76, and is held in place by clip 70. A conduit 94 is connected at one end to nozzle 56 and at the other end to a pump or a container (not shown) having the product that is to be dispensed. Conduit 94 is flexible and is designed to deliver doses of the product that is to be dispensed from the pump. From nozzle 56, conduit 94 extends out of nozzle assembly 38 by passing around the circumferential wall portion 88 of pivot stop 54 and through the second open space 86 defined between second ends 64, 74 of wall portions 58, 60.

Nozzle 56, through conduit 94, is in fluid communication with a source of product that is to be dispensed by dispenser 10 according to methods and structure known in the dispensing arts. In a typical arrangement, a flexible container of product is positioned within a volume defined within the housing and is connected to a pump, which in turn, is connected to a dispensing nozzle. In a bulk-fill dispenser, the housing defines an area for receipt of bulk product, and a pump communicates with that area of receipt to advance product to the dispensing nozzle. In dispensers employing refill units, the container of product and the pump would be provided as one unit to be received in the housing. The refill unit may include the conduit 94 and dispensing nozzle, with the conduit and nozzle being installed in the dispenser so that the dispensing nozzle is engaged with the rotatable dispensing nozzle assembly 38. In some embodiments, it might be preferred to provide such a refill unit inasmuch as all wetted parts would be disposed of and replaced when a particular refill unit is empty. Such an arrangement is suitable for dispenser 10, though other possible arrangements could also be used. The pump may be actuated by any known means, the actuation of the pump advancing an amount of product from the container toward dispensing nozzle 56. An appropriate pump may be chosen for a particular application, and the selection of an appropriate pump is within the skill of an ordinary practitioner in this art area. In one or more embodiments, a peristaltic pump may be appropriate and may operate by acting on a portion of a conduit between the container and the dispensing nozzle to advance a portion of product through the conduit toward the nozzle. Often, in peristaltic pumps, a roller passes over and squeezes the dispensing tube to advance product to the dispensing nozzle.

Figure 4A:
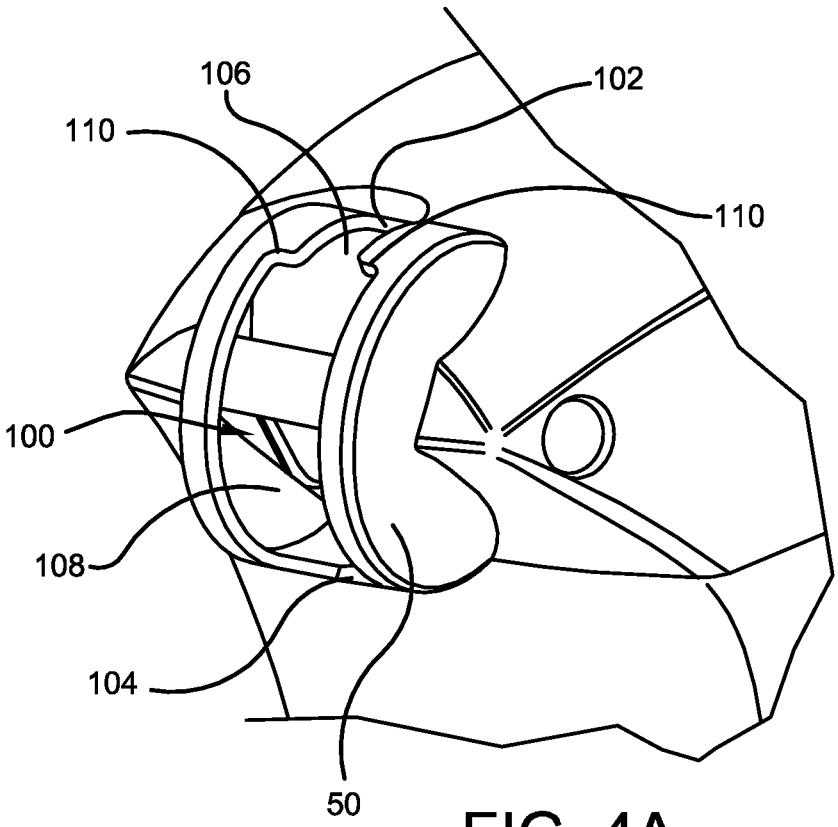
FIG. 4A is a perspective view of a portion of the dispenser showing the stationary housing of the dispensing nozzle assembly.

Turning to FIG. 4A, stationary housing 50 includes a circumferentially-extending slot 100 that extends from a first end 102 to a second end 104 and opens up from a narrow portion 106 to a wide portion 108 at shoulders 110. Referring especially to FIGS. 1-3, nub 68 extends through slot 100 in narrow portion 106 and nozzle 56 extends through slot 100 in wide portion 108.

Pivot 52 may be moved within stationary housing 50 to change the position of nozzle 56, which determines where a dosage of product is dispensed at outlet 57 of the dispensing nozzle. Referring to FIGS. 5A and 5B, two possible dispensing positions are shown. In FIG. 5A, pivot 52 is rotated the maximum possible distance in the clockwise direction. In that position, nub 68 contacts the first end 102 of slot 100. Also, ledge 80 of second wall portion 60 contacts second end 92 of pivot stop 54 (see FIG. 4). Such a dispensing position would be useful, for instance, when the dispenser 10 is mounted on a wall. In FIG. 2, dispenser 10 is shown mounted on a wall 130. Pivot 52 is shown in the position of FIG. 5A so that the outlet 57 of nozzle 56 is aimed to dispense product generally downwardly below dispenser 10 and away from wall 130. In such an arrangement, the user would receive a dosage of product directly below the dispenser 10, with the stream of product being dispensed running essentially parallel to the wall. An individual would place their hand under the dispensing nozzle in order to receive product dispensed from the outlet 57. It will be appreciated that it is most likely the individual would place their hand also under the undercut 44, though that may not be necessary in some configurations. The maximum possible distance that pivot 52 may be moved in the clockwise direction can be limited by adjusting the position of the first end 102 of slot 100, beyond which the nub 68 cannot move, or by adjusting the position of the second end 92 of pivot stop 54, which contacts ledge 80.

In FIG. 5B, pivot 52 is rotated the maximum possible distance in the counterclockwise direction (from the viewpoint of the dispenser as shown in FIGS. 5A and 5B). In that position, nozzle 56 contacts the second end 104 of slot 100. Also, nozzle carrying platform 76 of second wall portion 60 contacts first end 90 of pivot stop 54(see FIG. 4). Such a dispensing position would be useful, for instance, when the dispenser 10 is mounted on a countertop. In to FIG. 1, dispenser 10 is shown mounted on a countertop 120. Pivot 52 is shown in the position of FIG. 5B so that the outlet 57 of nozzle 56 is aimed to dispense product generally downwardly onto fingers and/or a hand positioned between the nozzle assembly 38 and countertop 120. In such an arrangement, the user would most likely place their fingers in the undercut 44 so that a significant portion of their hand is under the outlet 57 of the dispensing nozzle 56. receive a dosage of product below nozzle assembly 38 and between assembly 38 and the countertop, with the stream of product being dispensed toward the countertop. The maximum possible distance that pivot 52 may be moved in the counterclockwise direction can be limited by adjusting the position of the second end 104 of slot 100, beyond which nozzle 56 cannot move, or by adjusting the position of the first end 90 of pivot stop 54, which contacts nozzle carrying platform 76.

Of course, pivot 52 can be moved to any position between the positions shown in FIGS. 5A and 5B. And because the features of both slot 100 and pivot stop 54 can be used to limit the rotational movement of pivot 52, certain embodiments may be conceived of that do not include the movement-limiting features of both the slot and the pivot stop, as movement-limiting features in either one of the two structures may be enough. In addition, the movement of pivot 52 may be characterized by detents, notches, or other structure that allow the pivot to be easily moved to predetermined positions.

Dispensers constructed according to the concepts of the present invention may also include several optional features. User detection devices, such as motion sensors, can be incorporated into dispenser 10, along with electronic means for actuating the pump, to automate the operation of dispenser 10. Such detection devices and their methods of use and incorporation in dispensers are well known in the art. For example, a detection device could be incorporated into dispenser 10, such as near or projecting from bottom surface 22 or 30, and which senses when a user's hand enters dispensing area 44. Such a detection device would operate in either the wall or counter-mounted orientations, and would be associated with components that cause a dosage of product to be dispensed into the dispensing area 44.

Also, orientation-sensing devices may be incorporated into dispenser 10, along with electronic means for changing the position of pivot 52, the orientation-sensing device causing a change in the position of pivot 52 depending on whether dispenser 10 is mounted on a wall or on a countertop. Such orientation-sensing devices could be combined with the electronic means for changing the position of pivot 52 according to structure and methods that will be apparent to those skilled in the art.

Thus, dispensers constructed according to the concepts of the present invention are adapted to be capable of being mounted in both a generally horizontal orientation and a generally vertical orientation. For that matter, it will be apparent that the dispensers can be mounted in many orientations, including the horizontal orientation (countertop-mounted orientation) and vertical orientation (wall-mounted orientation). A rotatable dispensing nozzle assembly facilitates the multiple mounting positions, as the product to be dispensed can be directed in any appropriate direction. And, because the type of refill unit used in dispenser does not depend on the orientation the dispenser is mounted in, the same type of refill unit can be used without regard to the mounting orientation of the dispenser. The fin shape of the dispenser and the position of the dispensing nozzle assembly also facilitate the multiple mounting positions, as the shape of the dispenser and the area it defines between adjacent structures (whether a wall or a countertop) provides a dispensing area for a user to receive a dosage of the product to be dispensed, such as soap. By having an arrangement disclosed herein, a dispenser will define a dispensing area outside the footprint defined by the back (or bottom) of the dispenser.

Thus, dispensers constructed according to the concepts of the present invention are readily adapted between wall-mounted and countertop-mounted applications and offer several advantages over prior art forms. Purchasers of dispensers will not have to choose between using wall-mounted or countertop-mounted dispensers, as the present invention can be used for both purposes. By only needing to purchase a single style of dispenser, purchasers of dispensers will also only need to purchase a single type of related accessories, such as refill containers.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A dispenser comprising:

a housing having a base selectively mounted to a vertical surface in a vertical mounting orientation and selectively mounted to a horizontal surface in a horizontal mounting orientation, said housing defining an undercut; and a rotatable dispensing nozzle assembly secured to said housing at said undercut and selectively rotated between a first position associated with the horizontal mounting orientation, and a second position associated with the vertical mounting orientation, wherein, in said first position, said dispensing nozzle is directed to dispense product toward said horizontal surface and said undercut provides a finger receipt area sufficient for at least the receipt of fingers between the dispensing nozzle and the horizontal surface and further wherein said dispensing nozzle is positioned to dispense product below said housing when said base is mounted in said vertical mounting orientation and said rotatable dispensing nozzle assembly is rotated to said second position.

2. The dispenser of claim 1, wherein said housing includes a front cover and a back cover, and a leading surface and a trailing surface being defined by said front cover and said back cover.

3. The dispenser of claim 2, wherein said front cover includes a front surface and a bottom surface, and said back cover includes a top surface and a bottom surface, said front surface of said front cover and said top surface of said back cover abut and form said leading surface, and said bottom surface of said front cover and said bottom surface of said back cover abut and form said trailing surface.

4. The dispenser of claim 3, wherein said back cover extends in a longitudinal direction between a first end proximate said top surface and a second end proximate said bottom surface, an orthogonal direction extends at a right angle from said longitudinal direction, and said nozzle assembly is positioned longitudinally beyond, and spaced from in said orthogonal direction, said second end.

5. The dispenser of claim 4, wherein said nozzle assembly comprises a pivot and a nozzle.

6. The dispenser of claim 5, wherein said pivot includes first and second circumferential wall portions, said nozzle being carried by one of said wall portions.

7. The dispenser of claim 6, wherein said pivot further includes a nub extending from one of said wall portions.

8. The dispenser of claim 6, wherein said nozzle assembly further comprises a housing, said housing including a circumferentially-extending slot.

9. The dispenser of claim 8, wherein said pivot includes a nub, and said nozzle and said nub extend through said circumferentially-extending slot.

10. The dispenser of claim 9, wherein said circumferentially-extending slot includes a narrow portion and a wide portion.

11. The dispenser of claim 10, wherein said circumferentially-extending slot further includes shoulders, said circumferentially-extending slot opening from said narrow portion to said wide portion at said shoulders.

12. The dispenser of claim 10, wherein said circumferentially-extending slot extends between a first end and a second end, and said nub is moveable in the area between said first end and said second end.

13. A dispenser being adapted to be capable of being mounted in both a horizontal orientation and a vertical orientation, the dispenser comprising:

a rotatable dispensing nozzle assembly adapted to be positioned in a first dispensing position associated with the horizontal orientation and a second dispensing position being associated with the vertical orientation, wherein said rotatable dispensing nozzle assembly can deliver a product from the dispenser in both of said first and second dispensing positions.

14. The dispenser of claim 13, wherein said dispenser is fin-shaped.

15. The dispenser of claim 13, wherein said dispenser includes a flat peripheral edge, said dispensing nozzle assembly being positioned longitudinally beyond and spaced from in an orthogonal direction, said peripheral edge.

16. The dispenser of claim 13, wherein said dispenser includes a flat peripheral edge, a footprint being defined by said peripheral edge.

17. The dispenser of claim 13, wherein said dispenser defines a dispensing area outside said footprint.

* * * * *